US009031275B2

(12) United States Patent
Brødsgaard

(10) Patent No.: US 9,031,275 B2
(45) Date of Patent: May 12, 2015

(54) HEADSET WITH A ROTATABLE SPEAKER HOUSING

(71) Applicant: Brian Brødsgaard, Solrød Strand (DK)

(72) Inventor: Brian Brødsgaard, Solrød Strand (DK)

(73) Assignee: GN Netcom A/S (DK)

( * ) Notice: Subject to any disclaimer, the term of this patent is extended or adjusted under 35 U.S.C. 154(b) by 0 days.

(21) Appl. No.: 14/076,185

(22) Filed: Nov. 9, 2013

(65) Prior Publication Data

US 2014/0133688 A1 May 15, 2014

(30) Foreign Application Priority Data

Nov. 13, 2012 (DK) ..... 2012 00717

(51) Int. Cl.

*H04R 25/00* (2006.01)
*H04R 1/10* (2006.01)
*H04R 5/033* (2006.01)

(52) U.S. Cl.

CPC ..... *H04R 1/105* (2013.01); *H04R 1/1066* (2013.01); *H04R 5/033* (2013.01); *H04R 5/0335* (2013.01)

(58) Field of Classification Search

CPC .... H04R 1/10; H04R 2205/022; H04R 1/105; H04R 5/0335; H04R 2201/10; H04R 2460/13; H04R 1/1016
USPC ..... 381/370–371, 374, 377–381
See application file for complete search history.

(56) References Cited

U.S. PATENT DOCUMENTS 5,412,736 A * 5/1995 Keliiliki ..... 381/381
5,729,615 A * 3/1998 Yang ..... 381/370
6,097,827 A 8/2000 Yang
6,427,018 B1 * 7/2002 Keliiliki ..... 381/381
7,013,018 B2 * 3/2006 Bogeskov-Jensen ..... 381/381
8,213,647 B2 * 7/2012 van der Bilt et al. ..... 381/330
8,265,328 B2 * 9/2012 Milde et al. ..... 381/381

FOREIGN PATENT DOCUMENTS

| | | |
|---|---|---|
| CN | 101147420 | 3/2008 |
| CN | 201440714 | 4/2010 |
| CN | 102027760 | 4/2011 |
| EP | 1705949 | 9/2006 |
| GB | 2096861 | 10/1982 |
| JP | 10-313494 | 11/1998 |

(Continued)

OTHER PUBLICATIONS

1st Technical Examination of Danish patent application No. PA 2012 00717 dated Jun. 25, 2013.

(Continued)

*Primary Examiner* — Suhan Ni
(74) *Attorney, Agent, or Firm* — Altera Law Group, LLC

(57) ABSTRACT

A headset (1) comprising an attachment device (2) for attaching the headset (1) to the head of a user and a speaker housing (3). The speaker housing 3 is connected slidable along and rotatable about a first axis (X) to the attachment device (2), such that it can be placed into a selected longitudinal and angular position within a longitudinal interval (LI) and an angular interval (AI). The longitudinal interval (LI) comprises a first zone (Z1) and a second zone (Z2), and the speaker housing (3) can rotate through a first angular interval (AI1), when in the first zone (Z1) and through a second angular interval (AI2), when in the second zone (Z2). The first angular interval (AI1) is larger than the second angular interval (AI2).

15 Claims, 7 Drawing Sheets

(56) References Cited

FOREIGN PATENT DOCUMENTS

| | | |
|---|---|---|
| JP | 2008205585 | 9/2008 |
| JP | 2011055177 | 3/2011 |
| KR | 20070033123 | 3/2007 |
| KR | 20080011504 | 2/2008 |

OTHER PUBLICATIONS

European Search Report dated Apr. 2, 2014 for European application No. EP13192636.
Chinese Office Action dated Jan. 6, 2015 for Chinese application No. 2013105716969 with English translation.

* cited by examiner

HEADSET WITH A ROTATABLE SPEAKER HOUSING

TECHNICAL FIELD

The invention relates to a headset comprising an attachment device for attaching the headset to the head of a user and a speaker housing, which is connected slidable along and rotatable about a first axis to the attachment device, such that it can be placed into a selected longitudinal and angular position within a longitudinal interval and an angular interval.

BACKGROUND ART

U.S. Pat. No. 5,729,615 (Cotron Corporation) discloses a headset according to the preamble wherein the attachment device is an ear hook and wherein the speaker housing is attached to the end of a boom which is passed through a sleeve, which again is attached to the ear hook.

When the headset is arranged with the ear hook around the ear, the speaker housing can be adjusted to the size of the ear by sliding the boom in the sleeve. The boom can also rotate in the in the sleeve, whereby the speaker housing can be adjusted for optimum fit and rotated approximately 180° for changing between left ear use and right ear use. A problem with such a high degree of rotational freedom is that it is more cumbersome to attach the headset, as the user must pre-adjust it before attaching it to the ear.

U.S. Pat. No. 8,213,667 (Nixon, Inc) discloses a headset of the earphone type comprising two speaker housings and a headband as attachment device. The speaker housings are attached to the headband by a ball and socket arrangement, whereby the speaker housings can be rotated approximately 90° into a compact position, whereby the headset is more flat and easier to stow. The ball and socket arrangement gives a high degree of rotational freedom, whereby the headset becomes more "articulated" or "rickety" making it more cumbersome to attach to the head.

In this application the term headset should be interpreted broadly to cover all head worn audio devices comprising a speaker housing and an attachment device, including mono and stereo headphones and communication headsets comprising a microphone.

DISCLOSURE OF INVENTION

It is an object of the invention to provide a headset with an improved rotational speaker housing.

The disclosure provides a headset comprising an attachment device for attaching the headset to the head of a user and a speaker housing, which is connected slidable along and rotatable about a first axis to the attachment device, such that it can be placed into a selected longitudinal and angular position within a longitudinal interval and an angular interval, wherein the longitudinal interval comprises a first zone and a second zone, and wherein the speaker housing can rotate through a first angular interval, when in the first zone and through a second angular interval, when in the second zone, and wherein the first angular interval is larger than the second angular interval. With such a headset it is possible to provide large rotational freedom between the attachment device and the speaker housing together with an improved attachment procedure.

According to an embodiment, the first angular interval is at least 180° and wherein the speaker housing—when in the second zone—can rotate through a third angular interval, which is the same size as the second angular interval, and which is displaced approximately 180° from the second angular interval. This embodiment can be utilized for changing the headset between left ear use and right ear use.

According to a preferred embodiment, the speaker housing can only enter the second zone when the angular position is within the second angular interval or the third angular interval.

The attachment device may be an ear hook.

The ear hook may comprise headset electronics.

According to an embodiment, the headset comprises a boom, which is fixedly connected to the speaker housing and rotatably connected to the attachment device.

The boom may comprise one or more cams which engage grooves in a boom receptacle of the attachment device, when in the second zone.

According to an embodiment, the second and third angular intervals are less than 30°, for example less than 20°.

According to an embodiment, the first angular interval and the second angular interval have a common first angular end position, and wherein the first angular interval and the third angular interval have a common second angular end position. This facilitates the longitudinal movement of the speaker housing from the first zone into the second zone, as the user just moves the speaker housing to the first or second angular end position before he displaces the speaker housing longitudinal into the second zone.

According to an embodiment, the first zone is smaller than the second zone.

According to an embodiment, the first zone makes up 10% or less of the longitudinal interval.

BRIEF DESCRIPTION OF THE DRAWINGS

The invention is explained in detail below with reference to the drawing illustrating a preferred embodiment of the invention and in which.

MODE FOR CARRYING OUT THE INVENTION

In the following, non-limiting embodiments of the invention will be described in detail.

Figure 1:
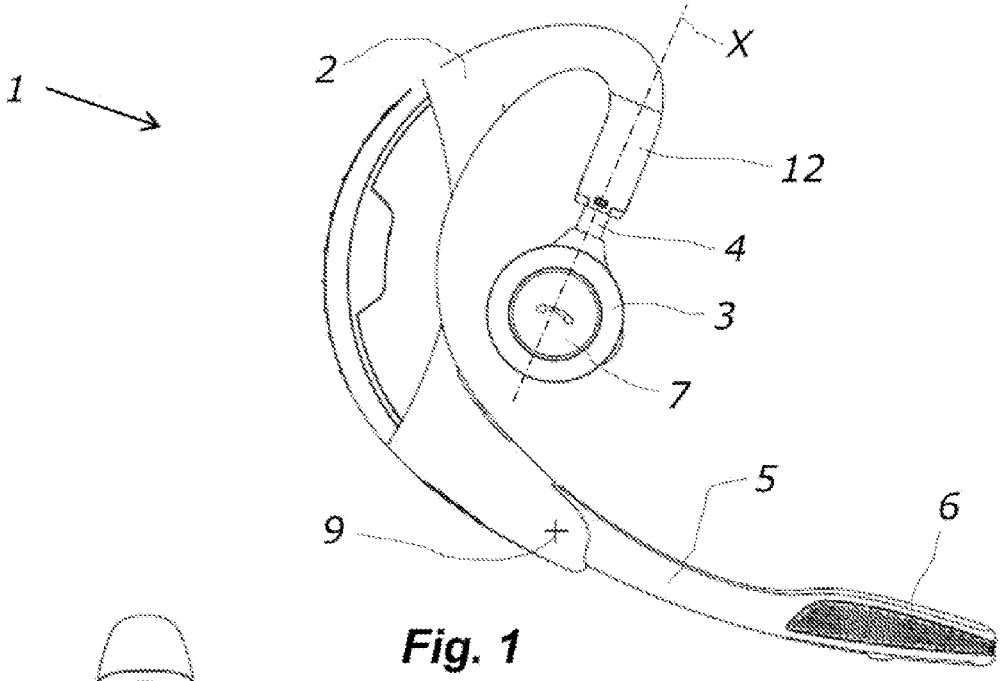
FIG. 1 is a side view of a first embodiment of a headset according to the invention.
Figure 2:
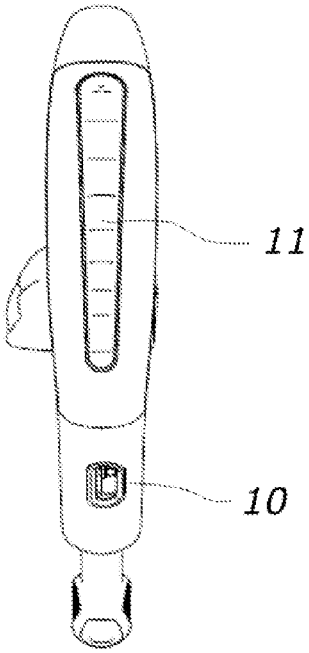
FIG. 2 is an end view of the first embodiment.
Figure 3:
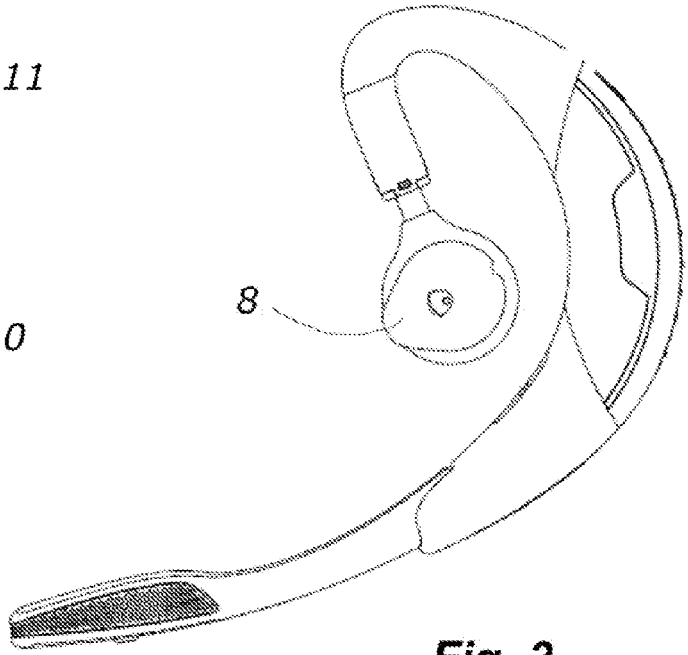
FIG. 3 is another side view of the first embodiment.

FIGS. 1-3 disclose a first embodiment of a headset 1 according the invention. The headset 1 is a Bluetooth headset of the monaural type. The headset 1 comprises a combined headset housing and ear hook 2, a speaker housing 3 and a microphone 6. The speaker housing 3 is connected to the ear hook 2 via a boom 4, which is received in a boom receptacle 12 of the ear hook 2. During use, the ear hook 2 is arranged around the outer ear, whereby the speaker housing 3 is located at the ear canal. The microphone 6 is positioned at the free end of a microphone arm 5, which can be folded in relation to the ear hook 2 about a microphone arm pivot axis 9 to a more compact position, where it lies parallel with the boom receptacle 12. The main part of the headset electronics, which comprises Bluetooth transceiver electronics, digital signal processing circuits, rechargeable battery etc., are located in the hollow ear hook 2. Electrical wires extend through the microphone arm 5 to the microphone 6 and through the boom 4 to a speaker located in the speaker housing 3. The side of the speaker housing 3 facing the users ear comprises an earbud 8, and the side of the speaker housing 3 facing away from the users ear during use comprises a multi-function button 7, which inter alia can be used for accepting phone calls. The back side of the ear hook 2 comprises a touch area 11 for adjusting the headset volume and a micro-usb socket 10 for charging and data exchange.

Figure 4:
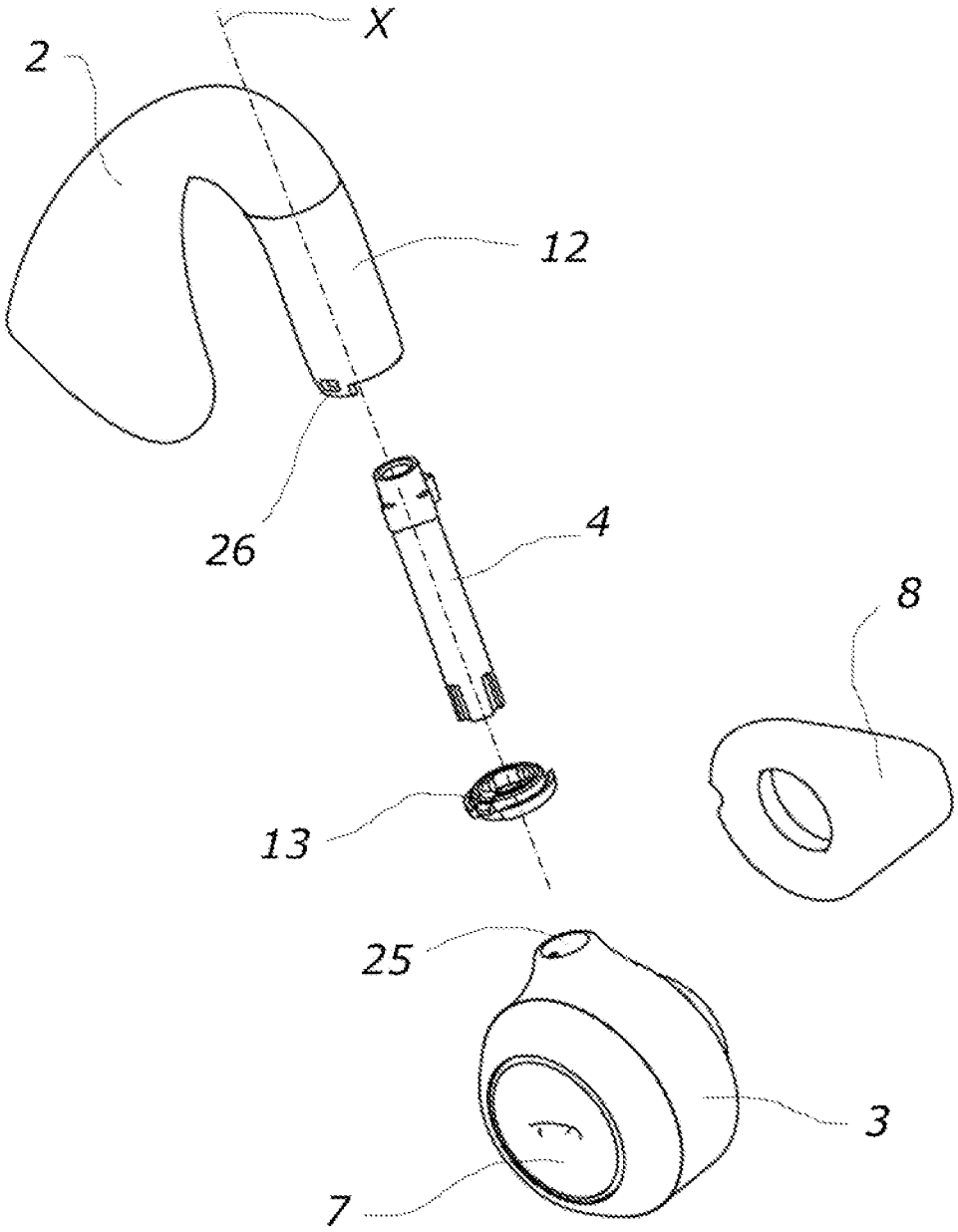
FIG. 4 is an exploded view of parts of the first embodiment, which are relevant for the invention.

FIG. 4 is an exploded view of parts of the first embodiment, which are relevant for the invention. As mentioned, the speaker housing 3 is connected to the ear hook 2 via a boom 4. The boom 4 is fixedly connected to the speaker housing 3, and inserted in the boom receptacle 12 of the ear hook 2, such that it can slide along and rotate about the axis X. During assembly, the lower end of the boom 4 is passed through a circular end cover 13 and inserted through hole 25 in speaker housing 3 where it is fastened. The upper end of the boom 4 is inserted in the boom receptacle 12, where after the end cover 13 is attached to the end of the boom receptacle 12 by means of boom receptacle fasteners 26, which engage correspondingly shaped protrusions on the end cover 13. When the end cover 13 is fastened, the boom 4 cannot leave the boom receptacle 12.

Figure 5:
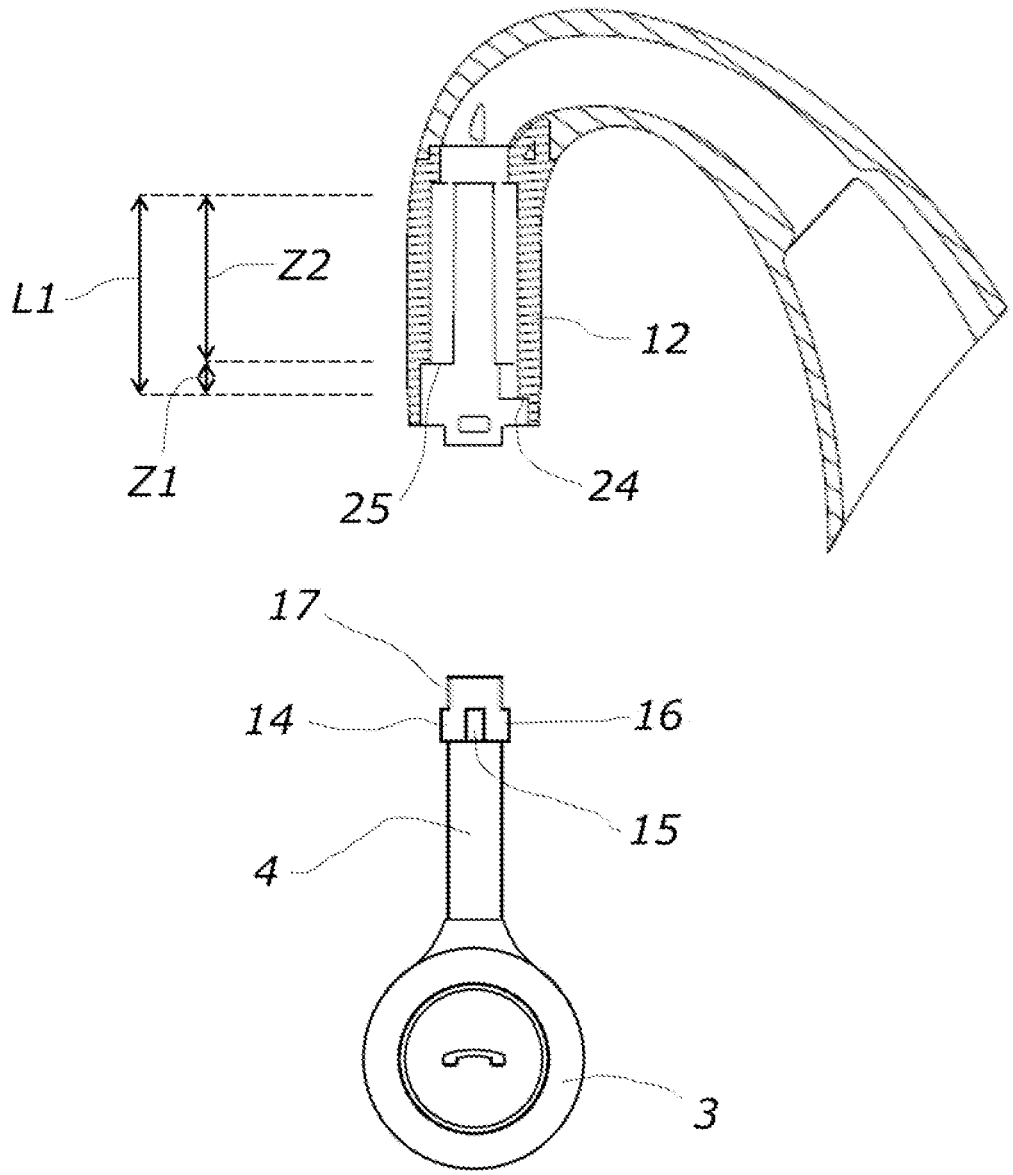
FIG. 5 is a side view, partial in section of the parts shown in FIG. 4.

FIG. 5 is a side view, partial in section of the parts shown in FIG. 4. The end cover 13 is left out for clarity reasons. The upper end of the boom 4 comprises four cams 14, 15, 16, 17, which protrudes radially from the boom 4. The four cams 14, 15, 16, 17 are positioned around the boom's circular periphery with 90° intervals. The three visible cams 14, 15, 16 are equal in size, whereas the fourth cam, which is not visible in FIG. 5, has the same longitudinal and tangential dimensions but protrudes more in radial direction than the other three. When inserted in the boom receptacle 12, the protrusions 14, 15, 16, 17 can slide in grooves, which will be described in relation to FIGS. 6-8. As indicated in FIG. 5, the boom 4 and thereby the speaker housing 3 can slide in a longitudinal interval L1, which comprises a first zone Z1 closest to the speaker housing 3 and a larger second zone Z2.

Figure 6:
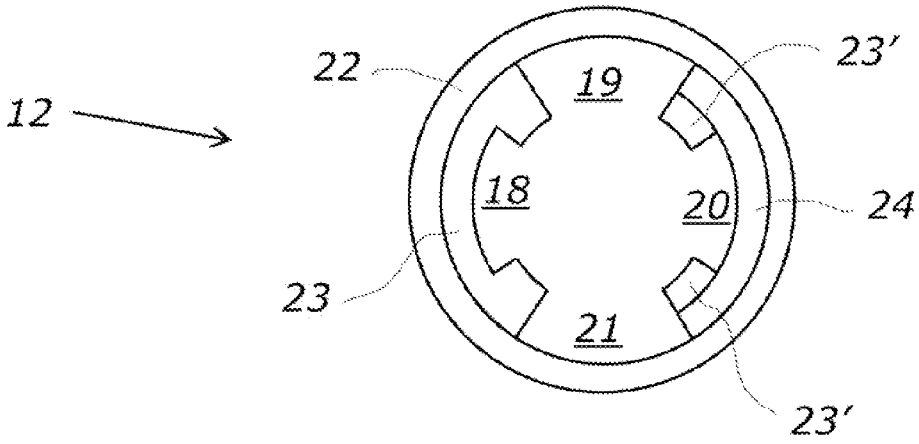
FIG. 6 is a bottom view of a receptacle to receive a boom connected to speaker housing

FIG. 6 is a bottom view of the boom receptacle 12 to receive the boom 4. The boom receptacle 12 comprises a wall 22 and a first groove 18, a second groove 19, a third groove 20 and a fourth groove 21. The cams 14, 15, 16, 17 can slide in these four grooves. The material surrounding the first groove 18 between the second groove 19 and the fourth groove 21 comprises a first end face 23. Also the two protrusions 23' defining the sides of the third groove 20 are parts of the first end face 23. A second end face 24 between the second groove 19 and the fourth groove 21 and the bottom of third groove 20 lies closer to speaker housing 3 than the first end face 23. The first end face 23 defines the border between the first zone Z1 and the second zone Z2 of the longitudinal interval LI—see FIG. 5.

Figure 7:
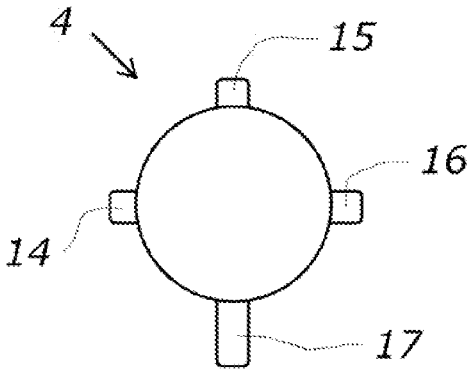
FIG. 7 is an end view of the boom connected to the speaker housing.

FIG. 7 is an end view of the boom 4 and it is clear, that the fourth cam 17 has a bigger radial dimension than the other three cams 14, 15, 16.

Figure 8:
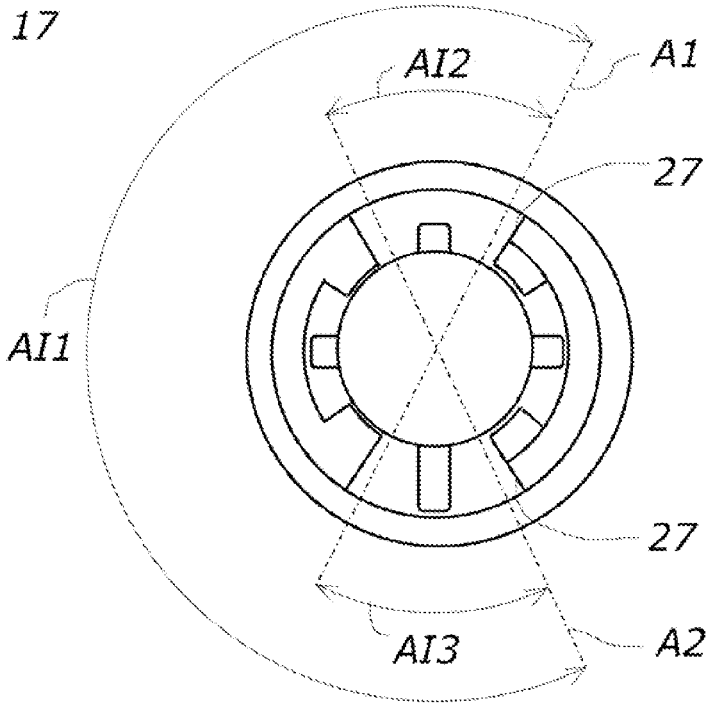
FIG. 8 is the boom of FIG. 7 inserted in the receptacle of FIG. 6, where the speaker housing is positioned for right ear use.

In FIG. 8 the boom 4 is inserted in the boom receptacle 12. The boom 4 is inserted into a depth corresponding to the second zone Z1, where the first cam 14 is positioned in the first groove 18, the second cam 15 is positioned in the second groove 19, the third cam 16 is positioned in the third groove 20 and the fourth cam 17 is positioned in the fourth groove 21. If the speaker housing 3 is pulled in a direction away from the ear hook 2 and into the first zone Z1 of the longitudinal interval L1, the cams 14, 15, 16, 17 are drawn out the grooves 18, 19, 20, 21. In the first zone Z1 the boom 4 can rotate through a first angular interval AI1 which is defined by the sides 27 of the second end face 27, as the fourth cam 17 will abut these in the outer positions A1 and A2 of the first angular interval A1. In the shown embodiment, the first angular interval A1 is approximately 200°. A second angular interval AI2 is defined by the second groove 19 and a third angular interval AI3 is defined by the fourth groove 21. Only the second groove 19 and the fourth groove 21 are deep enough in radial direction to receive the fourth cam 17. Thus, the speaker housing 3 can only enter the second zone Z2, when the fourth cam 17 is aligned with either the second groove 19 or the fourth groove 21, When the second groove 19 is entered by the fourth cam 17, the headset 1 is adapted to be used on the right ear. When the fourth groove 21 is entered by the fourth cam 17, the headset 1 is adapted to be used on the left ear. Thus, the first zone Z1 is primarily intended for changing the headset between right ear use and left ear use. When the speaker housing 3 is in the second zone Z2, the longitudinal position can be adjusted in order to adapt the headset 1 to the size of the users ear. Furthermore, the angle of the speaker housing 3 can be adjusted to the ear within the second angular interval AI2 and third angular interval AI3, respectively. The second and third angular intervals AI2, AI3 are equal and approximately 20°. The size of the second and third angular intervals AI2, AI3 are the angular size of the second and fourth groove minus the width of the cams 19, 21. The first, second and third grooves 18, 19, 20 and the first, second and third cams 14, 15, 16 could have been omitted, but are included in order to distribute the angular forces. As the cams are only 2 mm long and approximately 1 mm wide, they would easily break, if there were only on cam. Furthermore, a better guidance of the boom 4 in the boom receptacle 12 with less tendency to wobble is obtained with the additional cams, as they add to the radius of the boom 4.

In the shown embodiment, the longitudinal interval L1 is approximately 10 mm, where the first zone Z1 is approximately 1 mm, while the second zone Z2 is approximately 9 mm.

Figure 9:
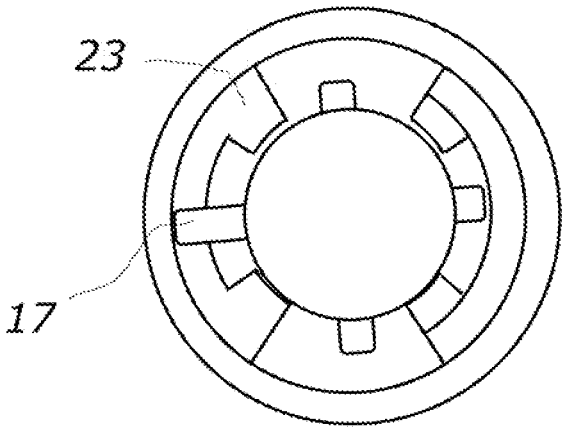
FIG. 9 is the boom and receptacle of FIG. 8 where the boom is rotated into an intermediate position.

In FIG. 9, the speaker housing 3 is in the first zone Z1 rotated into an intermediate position between right ear use and left ear use.

Figure 10:
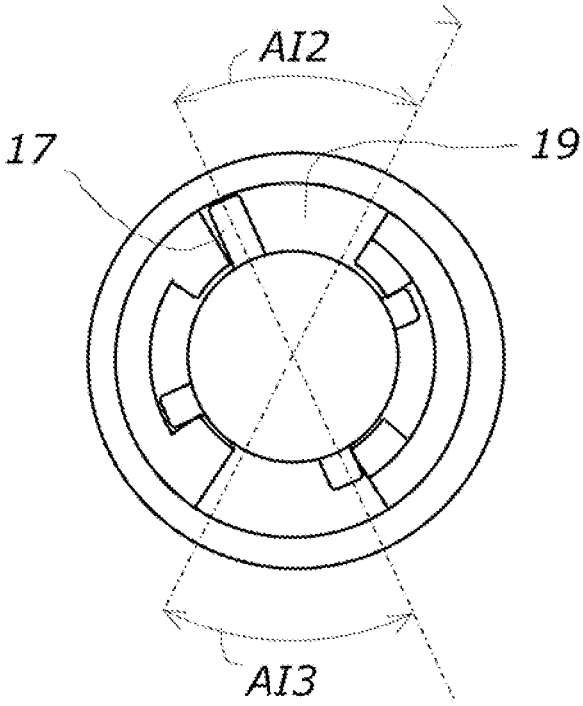
FIG. 10 is the boom and receptacle of FIG. 9, where, where the speaker housing is positioned for left ear use.

In FIG. 10, the fourth cam 17 is positioned in the second groove 19, whereby the speaker housing 3 is positioned for left ear use. The speaker housing 3 is also rotated to an outer position of the second angular interval AI2, whereby the cams 14, 15, 16, 17 abut the side of the respective grooves 20, 21, 18, 19.

Figure 11:
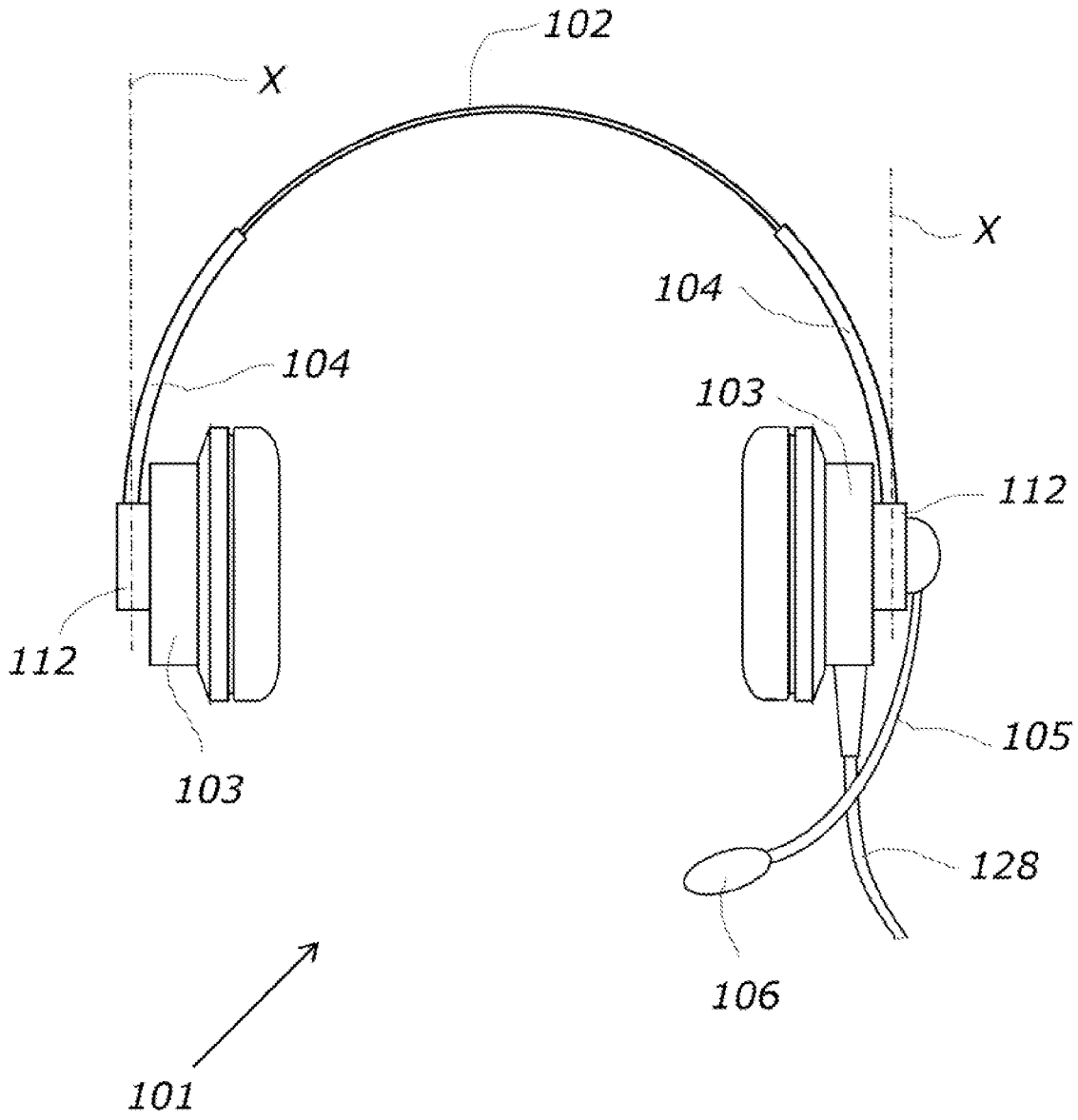
FIG. 11 is a headset according to a second embodiment of the invention.

FIG. 11 discloses a headset 102 according to a second embodiment of the invention. This headset 102 is a duo headset comprising two speaker housings or earphones 103, which are interconnected by a headband 102. A cord 128 and a microphone arm 105 with a microphone 106 extends from one of the speaker housings 103. The ends of the headband 102 are received in curved booms 104, which are inserted in boom receptacles 112 of the speaker housings 103. The curved booms 104 are received in the boom receptacles 112 essentially like booms 4 are received in the boom receptacles 12 of the first embodiment. Thus, the second embodiment is opposite the first embodiment, as the boom receptacle 112 is attached to the speaker housing 103 and not the attachment device 102. With this embodiment, the first zone is utilized for bringing the headset into a more compact position where the large surfaces of the headset housings are parallel with the plan of the headband 2. Therefore, the first angular interval in the first zone does not have to be as big as with the first embodiment.

Figure 12:
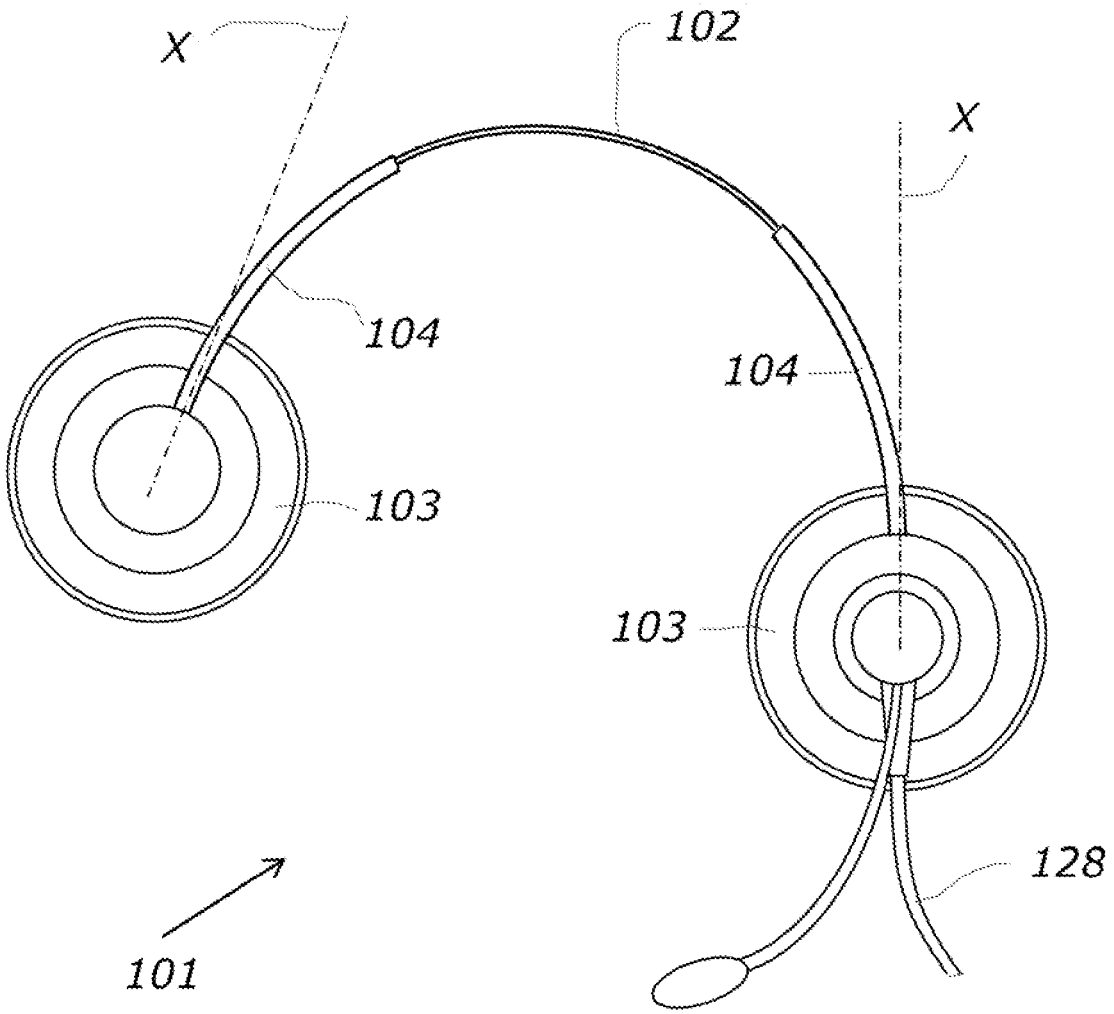
FIG. 12 is the headset of FIG. 9 in a compact position.

FIG. 12 discloses the headset of FIG. 11 in a compact position, where the earphones 103 are rotated approximately 90° in relation to the use position shown in FIG. 11. In FIG. 9, the speaker housings 103 are in the second zone Z2, in which they can rotated approximately ±15° in order to adapt the headset to the head of the user, which gives a second angular interval of 30°. Thus, the first angular interval is approximately 105°.

The invention is not limited to the embodiments above. Other attachment devices, such as neckbands or ear loops could be contemplated.

| Reference signs: | |
|---|---|
| 1 | headset |
| 2 | ear hook |
| 3 | speaker housing |
| 4 | boom |
| 5 | microphone arm |
| 6 | microphone |
| 7 | multi-function button |
| 8 | ear bud |
| 9 | microphone arm pivot axis |
| 10 | micro-usb socket |
| 11 | user interface |
| 12 | boom receptacle |
| 13 | end cover |
| 14 | first cam |
| 15 | second cam |
| 16 | third cam |
| 17 | fourth cam |
| 18 | first groove |
| 19 | second groove |
| 20 | third groove |
| 21 | fourth groove |
| 22 | wall |
| 23 | first end face |
| 24 | second end face |
| 25 | hole in speaker housing |
| 26 | fastener |
| 27 | sides of second end face |
| 101 | headset |
| 102 | headband |
| 103 | speaker housing |
| 104 | boom |
| 105 | microphone arm |
| 106 | microphone |
| 112 | boom receptacle |
| 128 | cord |
| A1 | first angular end position |
| A2 | second angular end position |
| Al1 | first angular interval |
| Al2 | second angular interval |
| LI | longitudinal interval |
| Z1 | first zone |
| Z2 | second zone |
| X | axis |

The invention claimed is:

1. A headset comprising an attachment device for attaching the headset to the head of a user and a speaker housing, which is connected slidable along and rotatable about a first axis (X) to the attachment device, such that it can be placed into a selected longitudinal and angular position within a longitudinal interval and an angular interval, wherein the longitudinal interval comprises a first zone and a second zone, and wherein the speaker housing can rotate through a first angular interval, when in the first zone around said first axis and through a second angular interval around said first axis, when in the second zone, and wherein the second angular interval is restricted to an interval smaller than the first angular interval, so that when the speaker housing is located in said first zone, it is free to rotate sufficiently to be usable for left and right ears of the user and wherein when said housing is in the second zone, it is restricted from rotation sufficient to be usable for left and right ears of the user.

2. A headset according to claim 1, wherein the first angular interval (AI1) is at least 180° and wherein the speaker housing when in the second zone can rotate through a third angular interval, which is the same size as the second angular interval, and which is displaced approximately 180° from the second angular interval.

3. A headset according to claim 2, wherein the speaker housing can only enter the second zone when the angular position is within the second angular interval or the third angular interval.

4. A headset according to claim 2, wherein the attachment device is an ear hook.

5. A headset according to claim 4, wherein the ear hook comprises headset electronics.

6. A headset according to claim 4, comprising a boom, which is fixedly connected to the speaker housing and rotatably connected to the attachment device.

7. A headset according to claim 2, wherein the second and third angular intervals are less than 30° , preferably less than 20°.

8. A headset according to claim 2, wherein the first zone is smaller than the second zone.

9. A headset comprising an attachment device for attaching the headset to the head of a user and a speaker housing, which is connected slidable along and rotatable about a first axis (X) to the attachment device, such that it can be placed into a selected longitudinal and angular position within a longitudinal interval and an angular interval, wherein the longitudinal interval comprises a first zone and a second zone, and wherein the speaker housing can rotate through a first angular interval, when in the first zone and through a second angular interval, when in the second zone, and wherein the first angular interval is larger than the second angular interval and wherein the first angular interval and the second angular interval have a common first angular end position, and wherein the first angular interval and the third angular interval have a common second angular end position.

10. A headset according to claim 7, wherein the first zone makes up 10% or less of the longitudinal interval.

11. A headset comprising:

a. an attachment device for attaching the headset to the head of a user b. a speaker housing being longitudinally connected to the attachment device and slideably extendable therefrom along a first axis, said housing being rotatable about said first axis such that the housing can be placed into selected longitudinal and angular positions within a longitudinal interval and an angular interval, wherein the longitudinal interval comprises a first zone and a second zone along said first axis, and wherein the speaker housing can rotate around said first axis through a first angular interval when in the first zone and through a second angular interval around said first axis, when in the second zone, and wherein the second angular interval is restricted to an interval which is less than the first angular interval, so that, when said housing is in the first zone it has greater rotational freedom than when in the second zone.

12. The headset of claim 11 wherein the first zone provides at least sufficient angular interval for the housing to be used on either ear of a user and wherein angular interval of the second zone is generally less than 30 degrees.

13. The headset of claim 11 wherein the speaker housing includes a cylindrical boom extension which is longitudinally slidable into the attachment device between first and second positions.

14. The headset of claim 11 wherein said first zone 10 percent or less of the sum of the first and second zones.

15. The headset of claim 11 wherein the speaker housing includes a cylindrical boom extension which is longitudinally slidable into said attachment device between first and second positions and further including a boom receptacle in said attachment device, and wherein said boom and boom receptacle includes cams and grooves which engage to establish said angular intervals in said zones.

* * * * *